US011794871B1

(12) United States Patent
Fergus et al.

(10) Patent No.: US 11,794,871 B1
(45) **Date of Patent: *Oct. 24, 2023**

(54) SYSTEMS AND METHODS FOR PRESERVING ELECTRICAL POWER IN A MARINE VESSEL HAVING A MARINE PROPULSION DEVICE

(71) Applicant: Brunswick Corporation, Mettawa, IL (US)

(72) Inventors: Ryan A. Fergus, Neenah, WI (US); Travis C Malouf, Germantown, WI (US); Justin R. Poirier, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/551,909

(22) Filed: Dec. 15, 2021

Related U.S. Application Data

(63) Continuation of application No. 16/721,027, filed on Dec. 19, 2019, now Pat. No. 11,247,762.

(51) Int. Cl.

| | |
|---|---|
| ***B63H 20/12*** | (2006.01) |
| ***B63H 20/00*** | (2006.01) |
| ***F04D 15/00*** | (2006.01) |

(52) U.S. Cl.
CPC ..... *B63H 20/12* (2013.01); *B63H 20/001* (2013.01); *F04D 15/0066* (2013.01); *F05B 2270/1033* (2013.01); *F05B 2270/20* (2013.01)

(58) Field of Classification Search
CPC ... B63H 20/12; B63H 20/001; F04D 15/0066; F05B 2270/1033; F05B 2270/20
See application file for complete search history.

(56) References Cited

U.S. PATENT DOCUMENTS

| | | | |
|---|---|---|---|
| 5,392,690 | A | 2/1995 | Hundertmark |
| 6,113,444 | A | 9/2000 | Ritger |
| 6,273,771 | B1 | 8/2001 | Buckley et al. |
| 6,402,577 | B1 | 6/2002 | Treinen et al. |
| 6,648,706 | B2 | 11/2003 | Kanno et al. |
| 6,652,330 | B1 | 11/2003 | Wasilewski |
| 6,821,168 | B1 | 11/2004 | Fisher et al. |
| 6,857,917 | B1 | 2/2005 | Wasilewski |
| 7,255,616 | B1 | 8/2007 | Caldwell |
| 7,699,674 | B1 | 4/2010 | Wald et al. |
| 7,812,467 | B1 | 10/2010 | Lemancik et al. |
| 8,046,122 | B1 | 10/2011 | Barta et al. |
| 9,849,957 | B1 | 12/2017 | Grahl et al. |
| 9,944,385 | B2 | 4/2018 | Lee et al. |
| 9,975,619 | B1 | 5/2018 | Gonring |

(Continued)

*Primary Examiner* — Stephen P Avila
(74) *Attorney, Agent, or Firm* — ANDRUS INTELLECTUAL PROPERTY LAW, LLP

(57) ABSTRACT

A method for preserving electrical power in a marine vessel. The method includes operating a variable operating device according to an original setting, measuring an actual system voltage for the marine vessel, and comparing the actual system voltage measured to a target system voltage. The method further includes adjusting the operation of the variable operating device from the original setting based on the comparison of the actual system voltage to the target system voltage, where adjusting the operation changes the electrical power usage in the marine vessel.

19 Claims, 7 Drawing Sheets

(56) References Cited

U.S. PATENT DOCUMENTS

| | | | | |
|---|---|---|---|---|
| 10,472,038 | B1 | 11/2019 | Walgren et al. | |
| 10,807,685 | B2 | 10/2020 | Petrin et al. | |
| 11,072,321 | B2 * | 7/2021 | Wenger | B60H 1/00771 |
| 11,247,762 | B1 * | 2/2022 | Fergus | B63H 20/001 |
| 2017/0342953 | A1 | 11/2017 | Morita | |

* cited by examiner

SYSTEMS AND METHODS FOR PRESERVING ELECTRICAL POWER IN A MARINE VESSEL HAVING A MARINE PROPULSION DEVICE

CROSS REFERENCE TO RELATED APPLICATION

This application is a continuation of U.S. patent application Ser. No. 16/721,027, filed Dec. 19, 2019, which is incorporated herein by reference in its entirety.

FIELD

The present disclosure generally relates to systems and methods for preserving electrical power in a marine vessel having a marine propulsion device, and more particularly to systems and methods for preserving electrical power in a marine vessel having a marine propulsion device, particularly by adjusting the operation of a variable operating device.

BACKGROUND

The following U.S. Patents provide background information and are incorporated by reference in entirety.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,652,330 discloses a method for controlling the electrical system of a marine vessel, including the steps of measuring a battery potential, comparing the battery potential to a threshold voltage magnitude, and then disconnecting one or more of a plurality of electrical power consuming devices when the voltage potential is less than the threshold voltage magnitude. This is done to avoid the deleterious condition wherein an engine of the marine vessel is operating at idle speed and attempting to charge the battery while a plurality of electrical power consuming devices are operating and drawing sufficient current from the alternator to prevent the proper charging of the battery. In these circumstances, the battery potential can actually be depleted as the battery attempts to provide the additional required electrical current for the loads.

U.S. Pat. No. 6,857,917 discloses a method for controlling the operation of the alternator in such a way that during certain conditions, such as rapid acceleration of a marine vessel in combination with a trimming maneuver, the alternator of the marine propulsion system is deactivated so that it does not provide a mechanical load on the engine during the accelerating maneuvers. This allows the engine to provide more power to the propeller and achieve the desired operating speed commanded by the operator of a marine vessel.

U.S. Pat. No. 7,812,467 discloses a smart alternator control circuit and method for limiting an alternator load on an internal combustion engine.

U.S. Pat. No. 9,975,619 discloses a method of controlling an alternator in a marine propulsion system that includes receiving a battery voltage level of a battery charged by the alternator, receiving a throttle demand value, determining whether the throttle demand value exceeds a demand threshold, and determining whether the battery voltage level exceeds a threshold minimum battery voltage. If the throttle demand value exceeds the demand threshold and the battery voltage level exceeds the threshold minimum battery voltage, then the alternator is controlled to reduce the charge current output to the battery and reduce engine output power utilized by the alternator.

Additional background for exemplary variable operating devices relating to the presently disclosed systems and methods can also be found in U.S. Pat. Nos. 5,392,690, 6,113,444, 6,402,577, 6,821,168, 7,255,616, 7,699,674, 8,046,122, 9,849,957, and 10,472,038.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a method for preserving electrical power in a marine vessel having a marine propulsion device. The method includes operating a variable operating device according to an original setting, measuring an actual system voltage for the marine propulsion device, and comparing the actual system voltage measured to a target system voltage. The method further includes adjusting the operation of the variable operating device from the original setting based on the comparison of the actual system voltage to the target system voltage, where adjusting the operation changes the electrical power usage in the marine propulsion device.

Another embodiment generally relates to an electrical power system for a marine propulsion device having a variable operating device. The power system includes a voltage sensor that measures an actual system voltage for the marine propulsion device, and a current sensor that measures an actual current drawn by the variable operating device during operation thereof, wherein the variable operating device is operable in an original setting. A memory system stores a target system voltage for the marine propulsion device and a target current for the variable operating device. A control system compares the actual system voltage to the target system voltage and that compares the actual current of the variable operating device to the target current. A control program is executable by the control system that, when the actual system voltage is determined to be below the target system voltage and the actual current is determined to exceed the target current, adjusts the operation of the variable operating device from the original setting.

Another embodiment generally relates to a method for preserving electrical power in a marine propulsion device with a steering system having a pump. The method includes operating the pump at a pump speed according to an original setting, measuring an actual engine speed of the marine propulsion device, and comparing the actual engine speed measured to a target engine speed. The method further includes adjusting the pump speed of the pump from the original setting based on the comparison of the actual engine speed to the target engine speed, wherein adjusting the operation changes the electrical power usage by the pump within the marine propulsion device.

Another embodiment generally relates to a method for preserving electrical power in a marine propulsion device with a steering system having a pump and a steering input device. The method includes operating the pump at a pump speed according to an original setting, measuring an actual pump speed for the pump, and determining a nominal steering demand from the steering input device based on the actual pump speed measured at the original setting. The method further includes measuring an actual steering demand received from the steering input device, comparing the actual steering demand to the nominal steering demand, and counting a first elapsed time during which the actual steering demand exceeds the nominal steering demand. The method further includes comparing the first elapsed time to an action time threshold, counting an actual event count each time the first elapsed time exceeds the action time threshold, and increasing the pump speed of the pump from the original setting only when the actual event count exceeds a target event count. The method further includes counting a second elapsed time during which the pump speed is increased from the original setting, and comparing the second elapsed time to a minimum adjusted time and preventing the pump speed from returning to the original setting when the second elapsed time is less than the minimum adjusted time. The electrical power in the marine propulsion device is preserved when the pump is operated with the pump speed at the original settings.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present disclosure generally relates to systems and methods for preserving electrical power in marine vessels having marine propulsion devices, and particularly those having variable operating devices therein. One such variable operating device is a power steering system, and particularly the pump and other components by which it operates. Another variable operating device is a power trim system, for example.

Through experimentation and development, the inventors have identified that electrical power systems for marine vessels presently known in the art do not adequately control the supply and demand of electrical power, allowing substantial drops in systems voltage as various devices are operated. These drops can negatively affect the performance for critical component in the marine propulsion device. Accordingly, the systems and methods disclosed herein provide for preserving a sufficient supply of system voltage, and particularly through adjustable operation of variable operating devices. This ensures that adequate system voltage remains to provide the functionality of critical devices, such as system diagnostics, steering actuation, and various engine and other subsystem controllers.

The inventors have particularly identified power steering pumps incorporated within power steering systems and power trim systems as being particularly demanding on system voltage. For simplicity, the examples used herein principally refer to power steering systems, such as those incorporating electro-hydraulic actuators.

Figure 1:
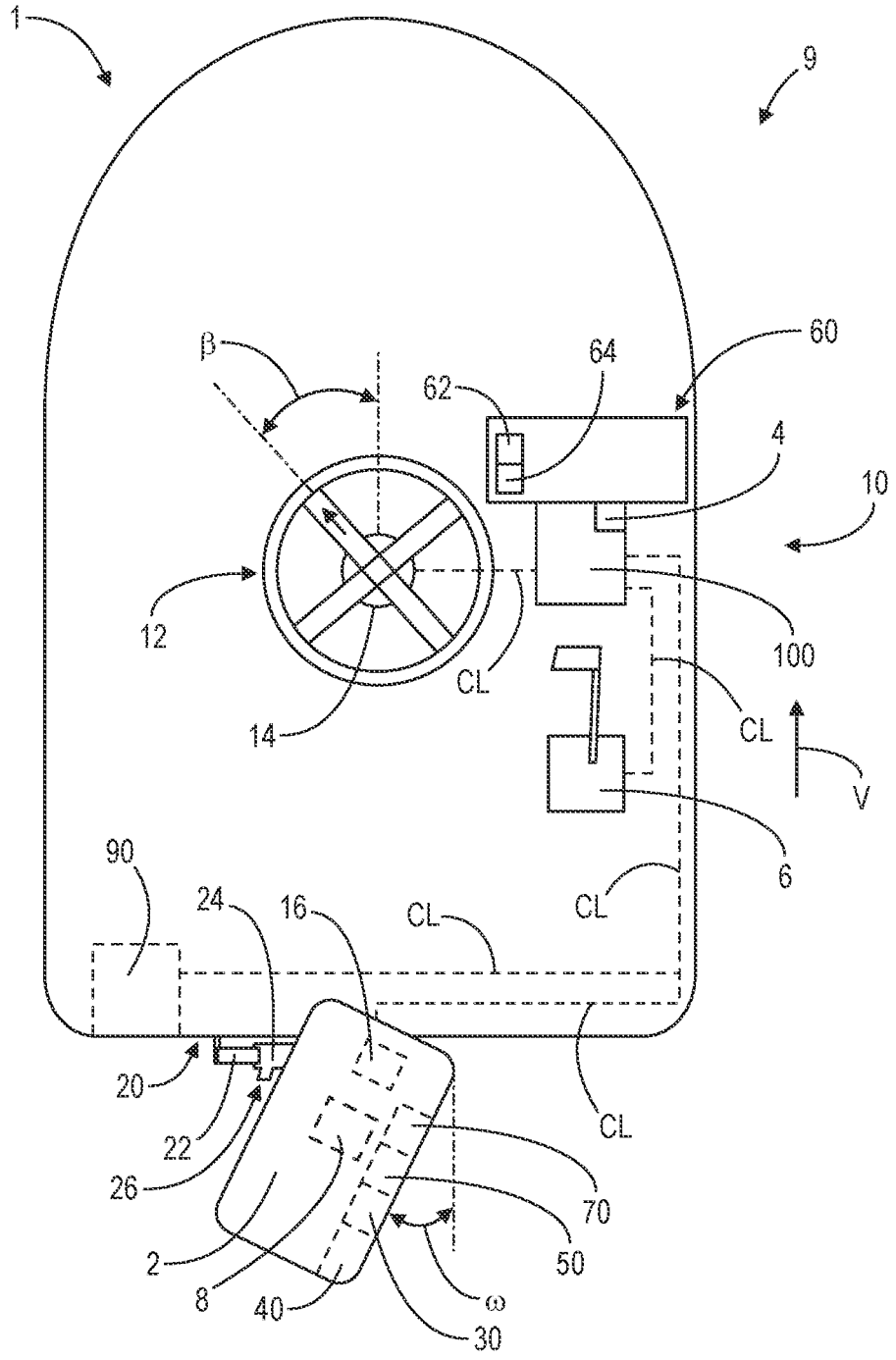
FIG. 1 is a top view representation of a marine vessel incorporating an electrical power system for preserving electrical power according to the present disclosure.

FIG. 1 depicts an exemplary embodiment of a marine vessel 1 configured to be propelled through the water by a marine propulsion device, such as an outboard motor 2. As will be described further below, the outboard motor 2 is steerable by a steering system 10 physically similar to those known in the art, but operated in accordance with one of the electrical power systems 9 of the present disclosure. The outboard motor 2 is further configured for operation with a trim system 5 (FIG. 2) also physically similar to those known in the art, but also configured to operate in accordance with an electric power system 9 as disclosed herein. It should be recognized that the power system 9 as used herein refers to all devices supplying, consuming, and/or managing power for the marine vessel 1.

The outboard motor 2 is controllable by a throttle controller 6 to propel the marine vessel 1 through the water at a velocity V in the manner known in the art. In the embodiment shown, the throttle controller 6 is operatively coupled to a control system 100, such as an engine control unit (ECU), and/or a central controller such as a helm control unit (HCU) or command control module (CCM), which may be provided with on the marine vessel 1 and/or the outboard motor 2. An exemplary control system 100 is discussed further below. It will recognized that the control system 100 shown in FIG. 1 is merely an example, and may be relocated or divided among multiple separate devices provided in connection with each other to provide the same functionality. A velocity sensor 4 is also operatively coupled with the control system 100 for detecting the velocity V of the marine vessel 1.

The marine vessel 1 is steerable by a steering input device 12, for example a conventional steering wheel as shown in FIG. 1. The steering input device 12 is rotatable about an axis to various steering input angles β relative to a straight ahead positon, which is detectable by a steering input angle sensor 14 also operatively connected to the control system 100. The steering system 10 consequently steers the outboard motor 2 according to the steering input angle β detected by the steering input angle sensor 14.

The steering system 10 of the present embodiment includes a hydraulic device 20 that upon actuation changes a steering angle ω of the outboard motor 2 relative to the straight ahead position (shown vertically, e.g. velocity v). This steering angle ω is detected by a steering angle sensor 16 corresponding to the outboard motor 2 in a manner similar to the steering input angle sensor 14 that detects the steering input angle β of the steering input device 12, as discussed above. Additional information regarding exemplary steering systems is provided in U.S. Pat. No. 10,472,038.

In the example shown in FIG. 1, the hydraulic device 20 includes a rod 22 configured to be extended and retracted relative to a cylinder 24 via pressure differentials between a first port 26 and a second port (not shown) in a manner known in the art. A pump 30 communicates hydraulic fluid HF (see FIG. 2) with the hydraulic device 20 to cause actuation thereof, which as discussed above is controlled at least in part by the steering input angle sensor 14 inputs to the control system 100. The pump 30 is operated at a pump speed, which impacts the speed of actuation, or rate of change, for the hydraulic device 20 (e.g. the rate at which the rod 22 extends or retracts from relative to the cylinder 24). It will be recognized that this in turn also impacts the rate of change of the outboard steering angle ω.

Figure 2:
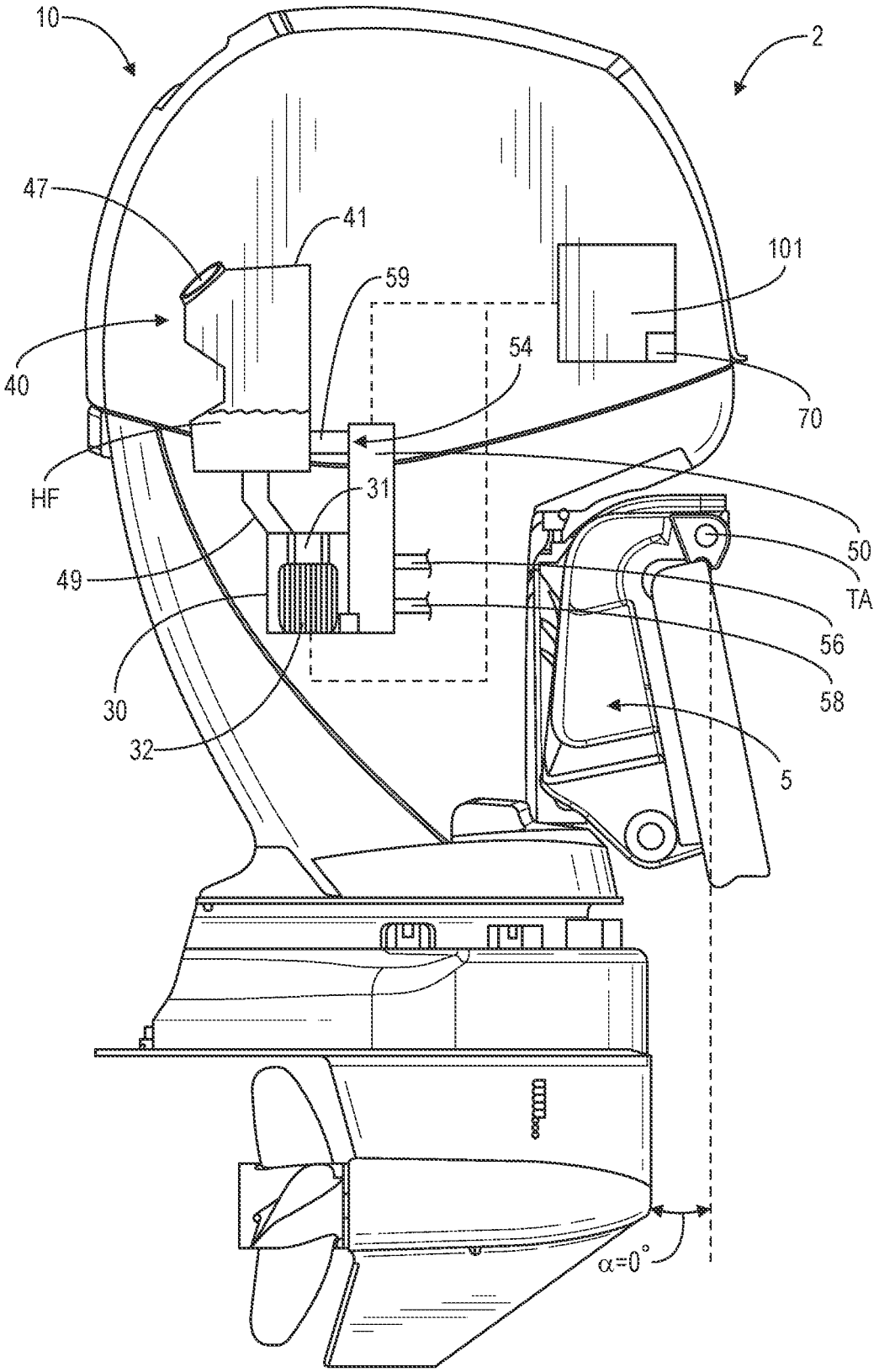
FIG. 2 is a side view of a marine propulsion device operable using the presently disclosed electrical power system such as may be incorporated within the marine vessel shown in FIG. 1.
Figure 3:
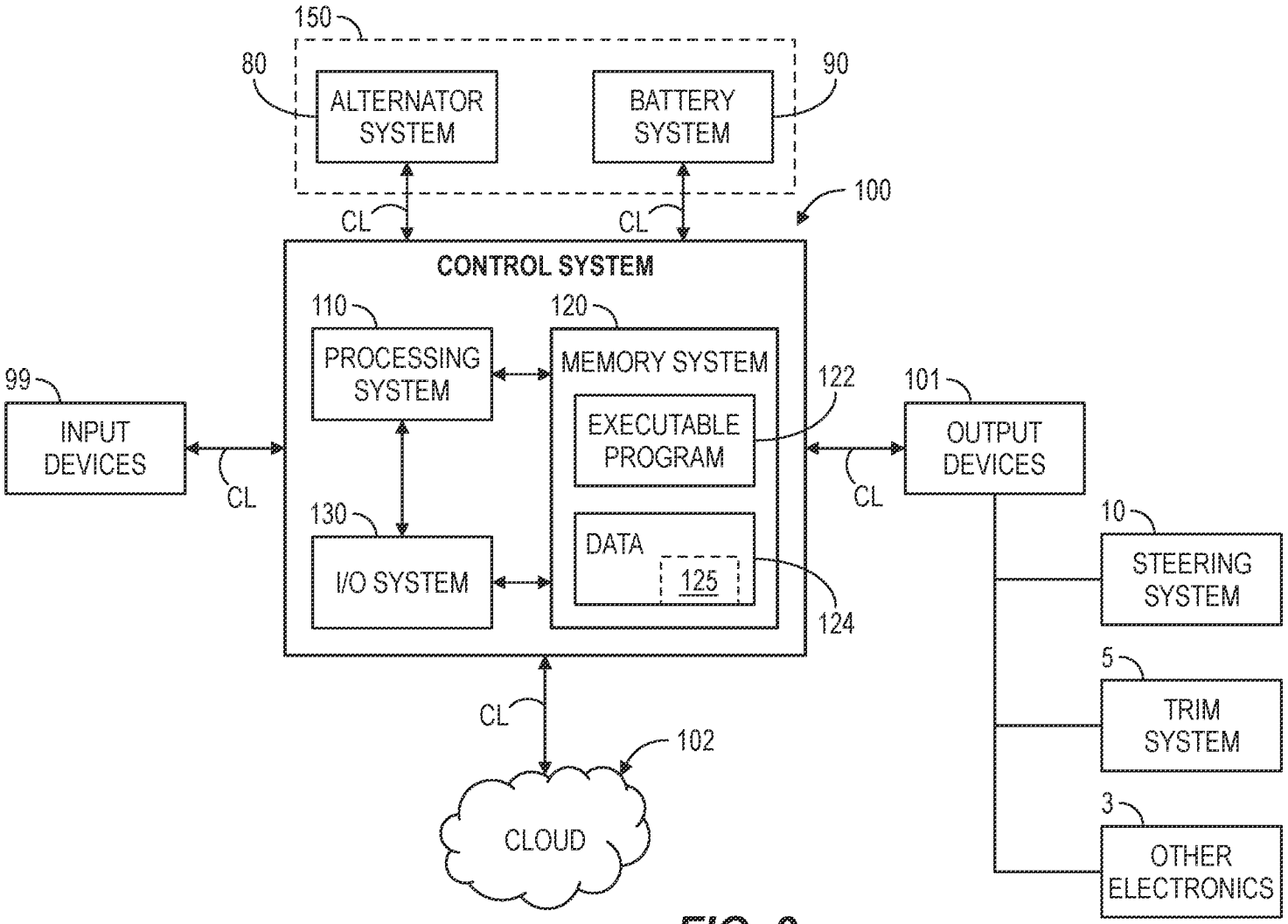
FIG. 3 is a schematic representation of an exemplary electrical power system according to the present disclosure.

As best shown in FIGS. 2 and 3, a reservoir 40 is fluidly couple to the pump 30 and configured to retain the hydraulic fluid HF therein. In the embodiment shown, the reservoir 40 has a top 41 and a bottom 43 and is fillable via a fill port 45 near the top 41 by removal of a cap 47. The reservoir 40 has a supply port 44 that in this example is provided at the bottom 43 of the reservoir 40, which is coupled to a conduit 49 for communicating the hydraulic fluid HF from the reservoir 40 to the pump 30, and specifically via a reservoir port 34 thereon. FIG. 2 further shows a fill level FL of the hydraulic fluid HF within the reservoir 40 (the pump 30 is presently shown to be entirely full). The reservoir 40 further includes a return port 46 for receiving hydraulic fluid HF returning via a conduit 59 from a valve 50 operatively connected to the hydraulic device 20, which is discussed further below.

Additional information is now provided for the exemplary pump 30 shown in FIG. 2. The pump 30 operates by rotating an impeller 32 via a motor 31, which in this example is controlled by a control system 100 previously discussed and/or a separate control system 100 within the outboard motor 2, which may also be referenced to as an engine control unit. Operation of the pump 30 forces hydraulic fluid HF received from the reservoir 40 out through a valve port 36, which is fluidly coupled to a valve 50.

The valve 50 has a pump port 52 for receiving hydraulic fluid HF from the pump 30, as well as a reservoir port 54 for selectively returning hydraulic fluid HF back to the reservoir 40 via the conduit 59. The valve 50 is controllable by a control system, such as the control system 100 discussed above, to control the flow of hydraulic fluid HF through the pump port 52 and the reservoir port 54, as well as through a first port 56 and second port 58. In the example shown, the first port 56 of the valve 50 is fluidly coupled to the first port 26 of the hydraulic device 20, and likewise the second port 58 of the valve to the second port 28 of the hydraulic device 20, to selectively actuate the hydraulic device 20 to thereby steer the outboard motor 2 in either direction.

With continued reference to FIG. 2, the outboard motor 2 is also provided with a trim system 5 for adjusting a trim angle α between the outboard motor 2 and the vertical plane. The outboard motor 2 is shown in FIG. 2 at a trim angle α of zero degrees. Returning to FIG. 1, the outboard motor 2 is further outfitted with a trim sensor 70 that is operatively coupled to the control system 100 and configured to detect the trim angle α of the outboard motor 2 throughout adjustment of the trim system 5. In the example shown, an operator controls the trim angle α through use of a trim up actuator 62 and a trim down actuator 64 provided within a control panel 60 coupled to the control system 100 in a manner presently known in the art. In this example, the control system 100 receives inputs from the trim up actuator 62 and trim down actuator 64 for operating the trim system 5 to adjust the trim angle of the outboard motor 2 accordingly.

Through experimentation and research, the inventors have identified that the system voltage of the power system 9 for the marine vessel 1 varies greatly depending on the operation of the steering system 10, trim system 5, or other electronics 3, which may operate independently or concurrently, and at varying levels between off and fully-loaded states. For example, the electrical demands of the pump 30 within the steering system 10 vary according to the pump speed, which itself varies depending on the request of the steering input device 12 or other factors. Likewise, the inventors have identified that actuation of the trim system 5 is particularly energy intensive, also causing a significant drop in system voltage for the marine vessel 1.

The inventors have further identified that the steering system 10, trim system 5, and other electronics 3, each of which may be operated using variable operating devices such as the pump 30 previously described, can be controlled in a manner to preserve electrical power such that system voltage remains available for critical components. In one example, this includes incorporating a pump 30 within the steering system 10 that provides data regarding the actual voltage and/or current consumed during operation. Particular processes for operating these variable operating devices are discussed further below with respect to FIGS. 4-7.

An exemplary control system 100 for operating in conjunction with the presently disclosed systems and methods is shown in FIG. 3. As discussed above, a control system like the control system 100 of FIG. 3 may be provided within the outboard motor 2, within the marine vessel 1, or both. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components of the steering system 10 via a communication link CL, which can be any wired or wireless link. The control system 100 is capable of receiving information and/or controlling one or more operational characteristics of the steering system 10 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the steering system 10. Moreover, the communication link CL lines are meant only to demonstrate that the various control elements are capable of communicating with one another, and do not represent actual wiring connections between the various elements, nor do they represent the only paths of communication between the elements. Additionally, the steering system 10 may incorporate various types of communication devices and systems, and thus the illustrated communication links CL may in fact represent various different types of wireless and/or wired data communication systems.

The control system 100 may be a computing system that includes a processing system 110, memory system 120, and input/output (I/O) system 130 for communicating with other devices, such as input devices 99 and output devices 101, either of which may also or alternatively be stored in a cloud 102. In the context of the present systems and methods, many variable operating devices (e.g. pumps 30 and other components within the steering system 10, trim system 5, and/or other electronics 3) may function as both input devices 99 and output devices 101 based on measurements and feedback therefrom, for example. The processing system 110 loads and executes an executable program 122 from the memory system 120, accesses data 124 stored within the memory system 120, and directs the steering system 10 to operate as described in further detail below.

The processing system 110 may be implemented as a single microprocessor or other circuitry, or be distributed across multiple processing devices or sub-systems that cooperate to execute the executable program 122 from the memory system 120. Non-limiting examples of the processing system include general purpose central processing units, application specific processors, and logic devices.

The memory system 120 may comprise any storage media readable by the processing system 110 and capable of storing the executable program 122 and/or data 124. The memory system 120 may be implemented as a single storage device, or be distributed across multiple storage devices or sub-systems that cooperate to store computer readable instructions, data structures, program modules, or other data. The memory system 120 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

Figure 4:
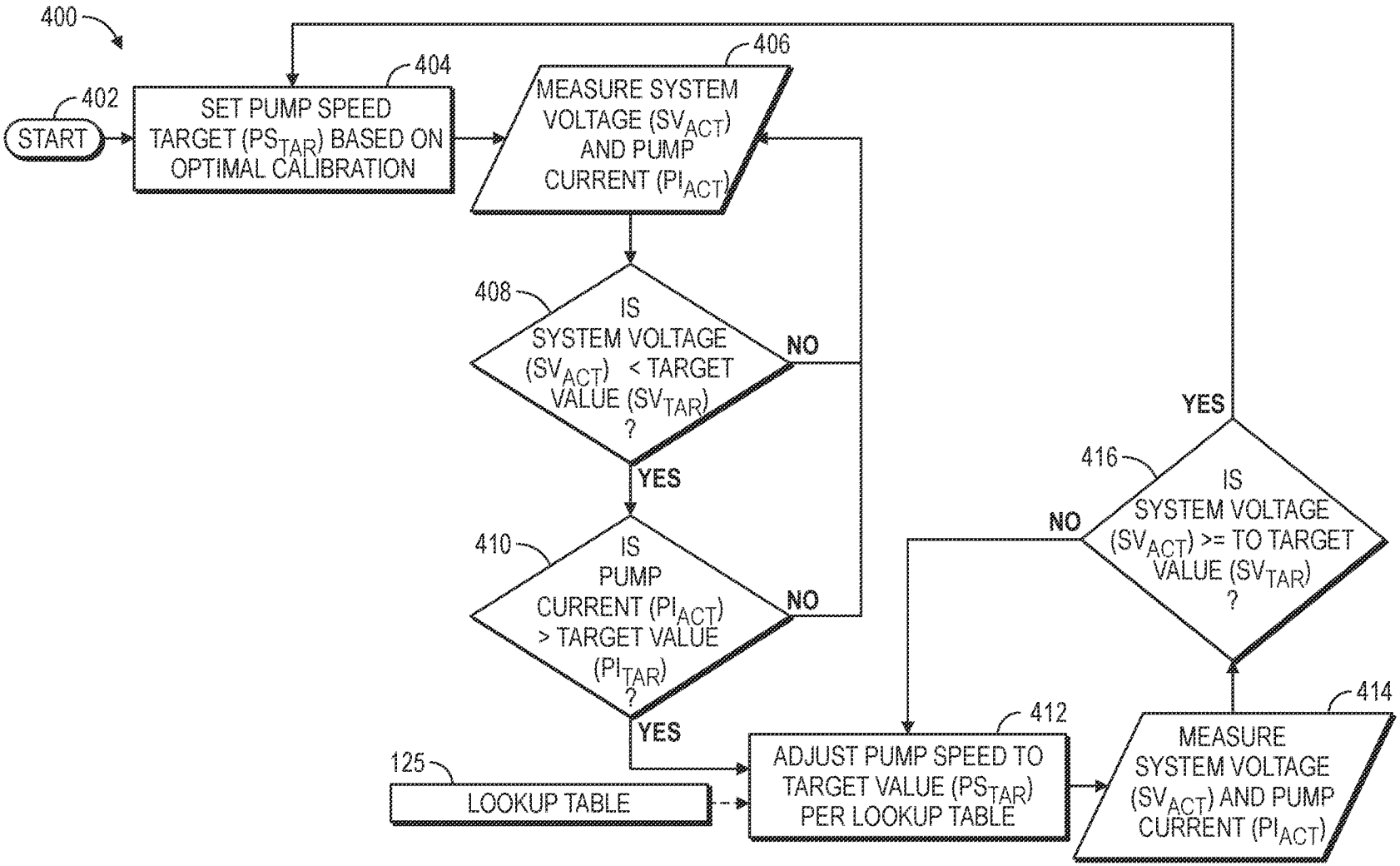
FIG. 4 is a first exemplary process flow for preserving electrical power according to the present disclosure.

Additional information is now provided for four exemplary process flows preserving electrical power in marine vessels, which will be described separately but may have overlapping concepts and sequences of steps. Moreover, steps shown in one process may be freely applicable for insertion into others, as will become apparent. A first process 400 is shown in FIG. 4 and generally relates to methods for reducing the electrical power consumption of a variable operating device in order to maintain a desired or required system voltage for the marine vessel 1. In an exemplary case, this may involve adjusting the voltage of a pump 30 within a steering system 10, particularly by varying the pump speed thereof. The process ensures the preservation of electrical power without requiring an alternator having a high enough output to handle the theoretical demand of all variable operating devices for all systems running simultaneously, for example.

The process 400 beings by starting at step 402 with general operation of the power system 9 presently disclosed. In step 404, a pump speed target PStar is set based on an optimal calibration, which may be stored in the memory system 120 of the control system 100 previously discussed. For example, the pump speed target PStar may start at a setting of 100%, providing maximum performance by the steering system 10. In step 406, the actual system voltage SVact is measured for the marine vessel 1, as well as an actual pump current PIact for the pump 30. It is then determined in step 408 whether the actual system voltage SVact is less than a system voltage target SVtar. If not, meaning that the actual system voltage SVact remains at or above the system voltage target SVtar, the process 400 continues in a cycle back at step 406. If instead it is determined in step 408 that the actual system voltage SVact is in fact below the system voltage target SVtar value, it is then determined in step 410 whether the actual pump current PIact is greater than a pump current target PItar value. This step confirms, within the context of controlling the pump 30 as the variable operating device, that the pump 30 is in fact the cause of the actual system voltage SVact being below the system voltage target SVtar. Specifically, step 410 confirms that the actual pump current PIact exceeds a threshold value indicating it as operating, or operating beyond a normal current level. If in step 410 it is determined that the actual pump current PIact is not above the pump current target PItar value, the process once again returns to step 406 to be repeated. If instead it is determined in step 410 that the actual pump current PIact does exceed the pump current target PItar value, the process 400 continues to step 412, whereby the pump speed is adjusted to a new pump speed target PStar value based on values in a lookup table 125, which may be stored in the memory system 120 previously discussed. The values in the lookup table may further be provided as a function of the actual system voltage SVact and/or actual pump current PIact.

The process 400 then continues by again measuring in step 414 the actual system voltage SVact and the actual pump current PIact, which are fed into step 416 to determine whether the actual system voltage SVact has now become greater than or equal to the system voltage target SVtar as a result of the adjustment of step 412. If step 416 is determined to be negative, further adjustments are made in step 412 and the process repeats. If instead the actual system voltage SVact is determined to have resolved in step 416, the process returns to step 404.

In certain embodiments, a new pump speed tar PStar different from the original optimal calibration may be set in step 204, specifically in recognition of the adjustment previously required in step 412.

Figure 5:
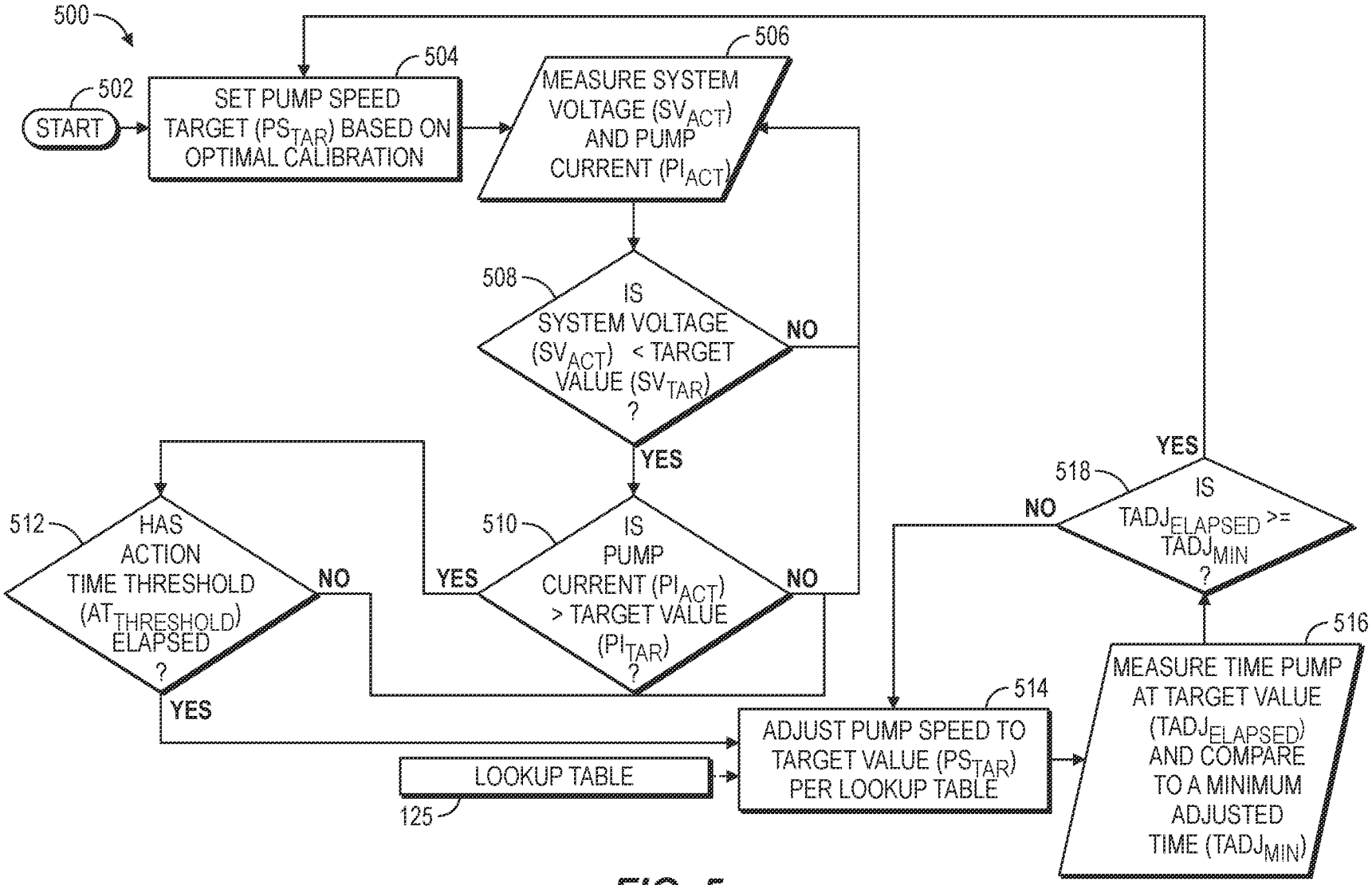
FIG. 5 is a second exemplary process flow for preserving electrical power according to the present disclosure.

An alternative embodiment for operating a power system 9 according to the present disclosure is depicted in FIG. 5 as the process 500. In general, it will be recognized that steps 502-510 of the process 500 begin in the same manner as steps 402-410 in the process 400 of FIG. 4. Additionally, if the determination of step 510 is determined to be in the negative, the process returns to step 506 in the same manner as a negative determination in step 410 returned to the step 406 in process 400. However, the process 500 introduces an additional determination prior to adjusting the pump speed, and in particular a determination when step 510 is found to be affirmative as to whether an action time threshold ATthreshold has elapsed in step 512. The action time threshold ATthreshold represents a minimum duration in which the actual system voltage SVact must be less than the system voltage target value SVtar, and/or the actual pump current PIact greater than the pump current target value PItar, before adjustment to pump speed should take place. This accommodates for momentary spikes or dips, or transient events within the power system 9 that do not require adjustment, or in other words do not have a detrimental effect to the system voltage of the marine vessel 1.

In this manner, if the determination of step 512 is the negative, the process returns to step 506 for further measurement in the manner previously described. Alternatively, if step 512 is determined in the affirmative, an adjustment to the pump speed is provided in step 514 in the same manner as previously described for step 412 of process 400.

However, in contrast to the adjustment provided in step 412 of process 400, the process 500 after step 514 proceeds to an additional comparison of time in step 516. In particular, step 516 provides for measuring the time the pump 30 is at the pump speed target PStar value as adjusted in step 514 (TADJelapsed), and comparing to a minimum adjusted time (TADJmin). Step 516 thereby provides that adjustments to the pump in step 514 must be maintained for a minimum adjusted time TADJmin before proceeding, preventing the pump 30 from being adjusted in fast succession. The inventors have identified that adjusting the pump 30 too frequently causes excess wear and tear on the pump 30, while also causing undesirable effects with respect to the noise and vibration of the pump 30, and excessive fluctuation to system voltage in the power system 9. Once it is determined in step 518 that the time that the pump 30 has been operated at the adjusted target value TADJelapsed exceeds the minimum adjusted time TADJmin, the process 500 returns to step 504, whereby the pump speed may be set to an original target, or another target in recognition of the system voltage previously requiring an adjustment.

Figure 6:
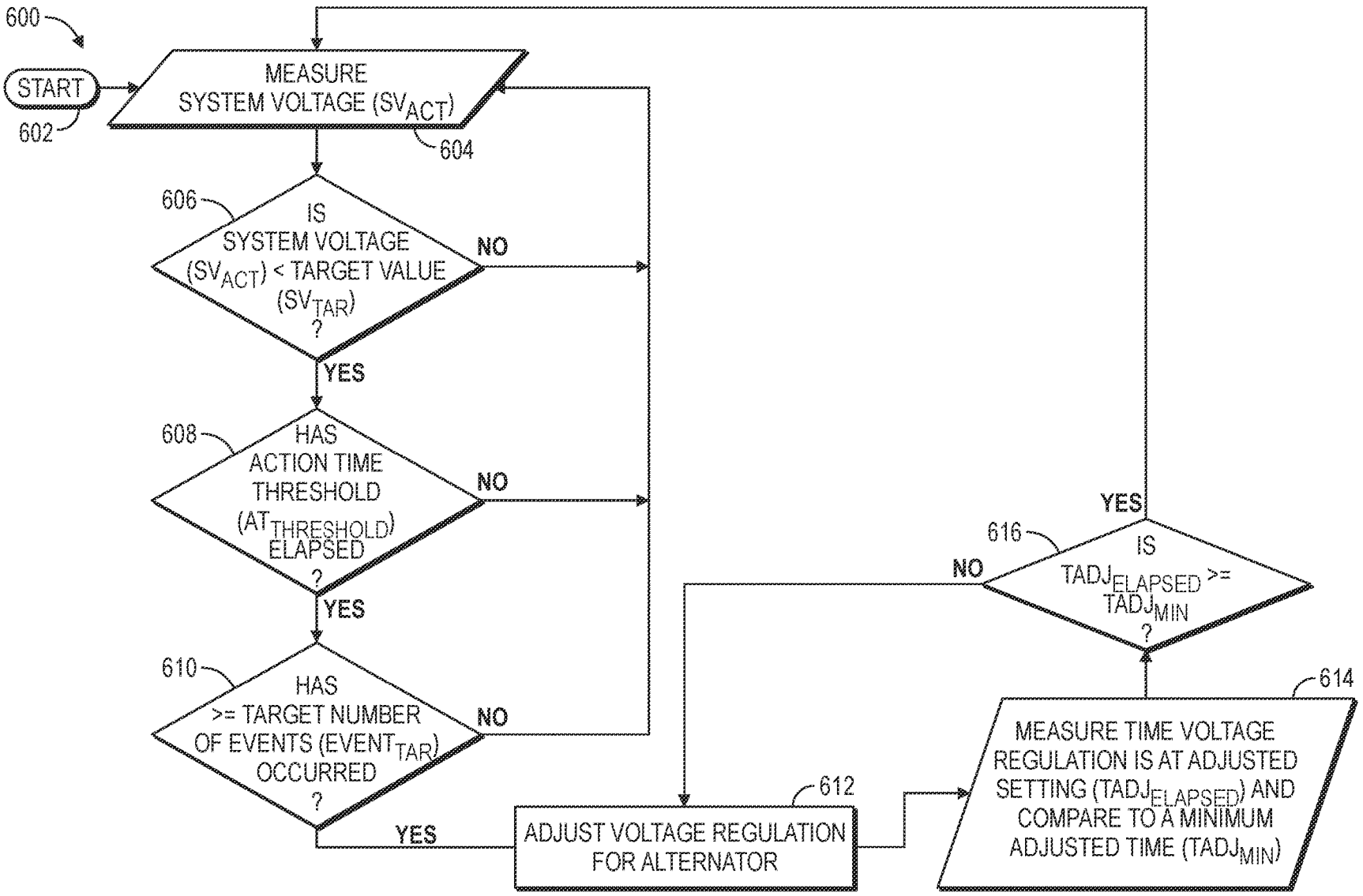
FIG. 6 is a third exemplary process flow for preserving electrical power according to the present disclosure.

FIG. 6 depicts another process 600 by which the integrity of electrical power of the marine vessel 1 is preserved particularly by addressing the sufficiency of the supply. In certain examples, the supply of electrical power is varied through use of a dynamically controllable alternator 8 (FIG. 1) of the variable operating device. The process 600 may provide for increased voltage regulation to provide more time, and/or greater margin between the charging voltage and the minimum critical voltage required for the marine vessel 1. After the start in step 602, step 604 provides for measuring the actual system voltage SVact of the power system 9 for the marine vessel 1. In step 606, it is determined whether the actual system voltage SVact is less than a system voltage target value SVtar. If step 606 is determined in the negative, the process 600 returns to step 604 for further measurement and comparison. If alternatively step 606 is determined in the affirmative, the process continues with step 608.

In step 608, it is determined whether an action time threshold ATthreshold has elapsed, which is similar to the step 512 discussed in the process 500 described above. This prevents the power system 9 from responding to a low system voltage prematurely, such as responding to temporary spikes, dips, or transient conditions that do not require correction. If step 608 is determined to be in the negative, the process again returns to step 604 and the cycle continues. In contrast, if step 608 is determined in the affirmative, the process continues at step 610.

In step 610, it is determined how many times the actual system voltage SVact has been determined in step 606 to be less than the system voltage target value SVtar, and also determined to exceed the action time threshold ATthreshold in step 608. It is then determined whether this occurrence number is greater than or equal to a target number of events EVENTtar. If the target number of events EVENTtar has not yet occurred, the process returns to step 604. If instead the target number of events EVENTtar has been met or exceeded as determined in step 610, the process continues with step 612, whereby the voltage regulation for the alternator is adjusted accordingly.

Once the alternator 8 is adjusted in step 612, the process continues with step 614, which provides for measuring the elapsed adjusted time that the voltage regulation for the alternator 8 has been adjusted (TADJelapsed) in accordance with step 612. The elapsed adjusted time TADJelapsed is then compared to a minimum adjusted time TADJmin also in step 614. If it is determined in step 616 that the elapsed adjusted time TADJelapsed is greater than or equal to the minimum adjusted time TADJmin, the process 600 returns to step 604 for further measurement of the actual system voltage SVact and repeats the process. If instead the elapsed adjusted time TADJelapsed has not yet met or exceeded the minimum adjusted time TADJmin in step 616, the process returns to step 612.

Figure 7:
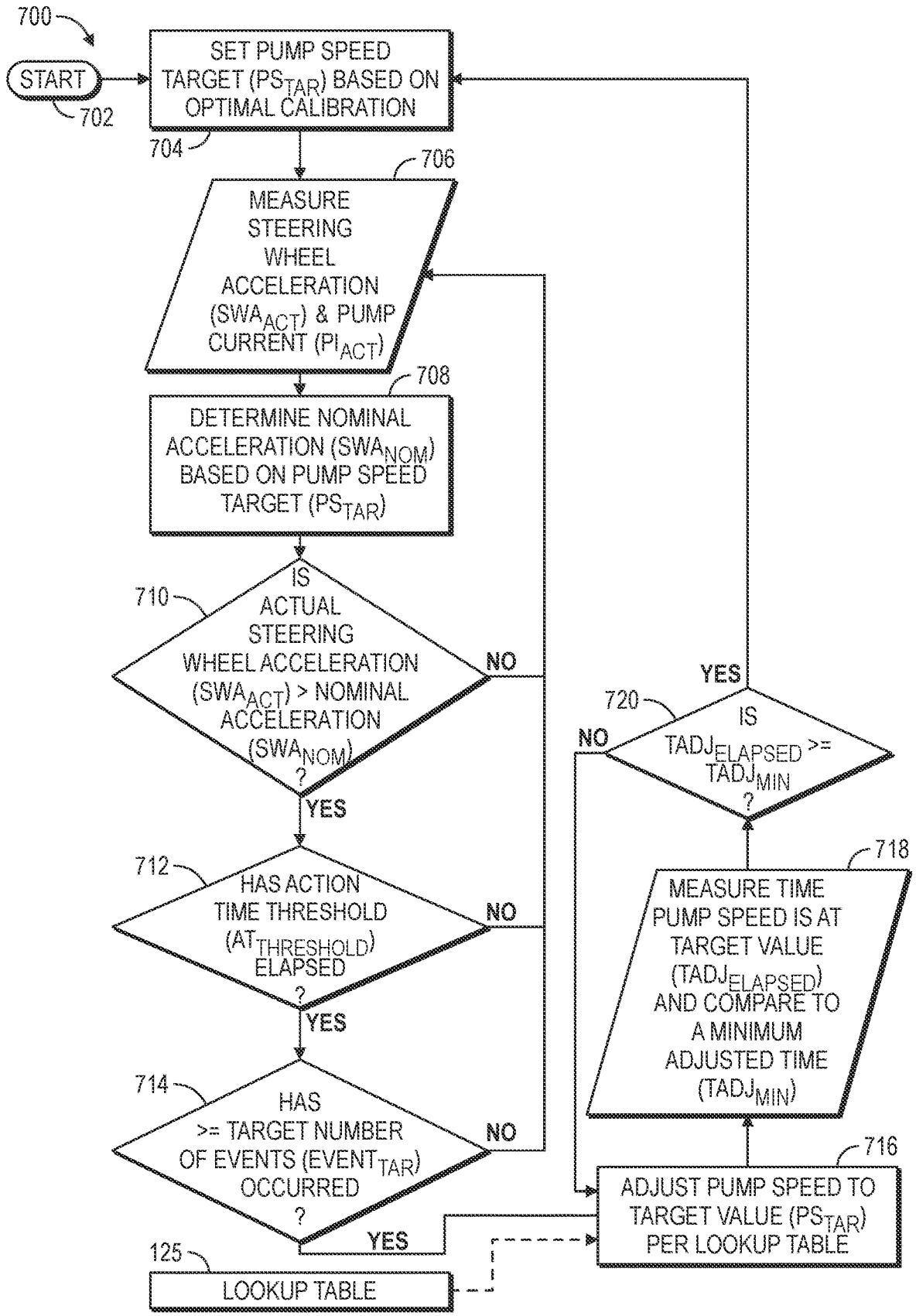
FIG. 7 is a fourth exemplary process flow for preserving electrical power according to the present disclosure.

FIG. 7 depicts another exemplary process 700 for preserving electrical power in a marine vessel 1, this time by generally increasing the power provided to a variable operating device beyond nominal values only as required by the present power demand. After starting in step 702, step 704 provides for setting the pump speed target PStar for the pump 30 based on an optimal calibration, similar to steps 504 and 404 discussed above with respect to process 500 and process 400, respectively. In step 706, a steering wheel acceleration SWAact and actual pump current PCact are measured in step 706. As previously discussed, the steering input device 12 is coupled to a steering input angle sensor 14 for detecting rotation of the steering input device 12. In addition to determining the steering input angle β by which the steering input device 12 is rotated, the same steering input angle sensor 14 may be used to determine the steering wheel acceleration SWAact, or the rate by which the steering input angle β changes via inputs from the steering input device 12.

A nominal acceleration SWAnom is then determined in step 708 based on the pump speed target PStar set in step 704, which may be stored in the lookup table 125 in the memory system 120 (FIG. 3). In step 710, it is then determined whether the actual steering wheel acceleration SWAact exceeds the nominal acceleration SWAnom from step 708. If the determination of step 710 (as well as those of step 712 and 714) are determined in the negative, the process 700 returns to step 706 and continues. If instead the determination of step 710 is in the affirmative, the process continues with step 712, which determines whether an action time threshold ATthreshold has been exceeded. This action time threshold ATthreshold of step 712 is similar to that described above with step 608 of process 600, requiring that a certain time has elapsed before action is taken based on the determination of step 710.

If the determination of step 712 is also determined in the affirmative, it is determined in step 714 whether a target number of events EVENTtar have been met or exceeded, which is similar to step 610 of process 600 as previously described. If step 714 is also determined in the affirmative, the pump speed for the pump 30 is adjusted in step 716 to a target value PStar in accordance with the lookup table 125. This adjustment of step 716 is similar to that previously described in step 514 of process 500. From there, step 718 provides for measuring an elapsed adjusted time TADJelapsed that the pump speed is operated at the adjusted target value from step 716, which is compared to a minimum adjusted time TADJmin. In this respect, step 718 is similar to step 516 as discussed above with process 500. If it is determined in step 720 that the elapsed adjusted time TADJelapsed is greater than or equal to the minimum adjusted time TADJmin, the process returns to step 704 and the cycle continues. If instead step 720 is determined in the negative, the process returns to step 716 until such time as the determination of step 720 is in the affirmative.

It will be recognized that as a separate or additive consideration for the processes discussed above, the pump speed of the pump 30 may also be varied depending on the available charge of the outboard motor 2, or in other words based on its engine speed. Specifically, engine speed provides a direct correlation to the power available within the power system 9, as it correlates to the output of an alternator 8. In this manner, the pump speed of the pump 30 may be directly operated in conjunction with the expected output of the alternator 8, which may be particularly applicable in the context of an alternator 8 that is not itself adjustable or dynamic.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for preserving electrical power in a marine vessel, the method comprising:

operating a variable operating device according to an original setting;

measuring an actual system voltage for the marine vessel;

comparing the actual system voltage measured to a target system voltage;

measuring an actual electrical consumption of the variable operating device and comparing the actual electrical consumption of the variable operating device to a target electrical consumption; and adjusting the operation of the variable operating device from the original setting based on the comparison of the actual system voltage to the target system voltage and the comparison of the actual electrical consumption to the target electrical consumption, wherein adjusting the operation changes the electrical power usage in the marine vessel.

2. The method according to claim 1, further comprising adjusting the operation of the variable operating device only when the actual system voltage is below the target system voltage and the actual electrical consumption exceeds the target electrical consumption.

3. The method according to claim 2, further comprising counting a first elapsed time during which the actual system voltage is below the target system voltage and the actual electrical consumption exceeds the target electrical consumption, and further comprising adjusting the operation of the variable operating device only when the first elapsed time exceeds an action time threshold.

4. The method according to claim 3, wherein the action time threshold is at least five microseconds.

5. The method according to claim 2, further comprising, after adjusting the operation of the variable operating device, re-measuring the actual system voltage and comparing the actual system voltage re-measured to the target system voltage, and re-measuring the actual electrical consumption of the variable operating device and comparing the actual electrical consumption to the target electrical consumption, and further comprising adjusting the operation of the variable operating device as long as the actual system voltage is below the target system voltage and the actual electrical consumption exceeds the target electrical consumption.

6. The method according to claim 1, further comprising counting a second elapsed time during which the operation of the variable operating device is operating adjustedly from the original setting, and further comprising preventing the operation from returning to the original setting when the second elapsed time is less than a minimum adjusted time.

7. The method according to claim 6, wherein the minimum adjusted time is at least three seconds, and wherein the target system voltage is less than 12 VDC.

8. The method according to claim 1, wherein the operation of the variable operating device is adjusted based on values in a lookup table.

9. The method according to claim 1, wherein the variable operating device is a pump in a power steering system.

10. The method according to claim 9, wherein the operation that is adjusted is a pump speed of the pump.

11. The method according to claim 1, wherein the actual electrical consumption is measured as electrical current.

12. The method according to claim 1, wherein adjusting the operation of the variable operating device is further based on at least one of a steering angle for a marine propulsion device propelling the marine vessel and a velocity thereof.

13. A method for preserving electrical power in a marine vessel, the method comprising:

operating a variable operating device according to an original setting;

measuring an actual system voltage for the marine vessel;

comparing the actual system voltage measured to a target system voltage; and adjusting the operation of the variable operating device from the original setting based on the comparison of the actual system voltage to the target system voltage, wherein adjusting the operation changes the electrical power usage in the marine vessel;

wherein the variable operating device is an alternator, and wherein the operation that is adjusted is the voltage output of the alternator.

14. The method according to claim 13, further comprising counting a first elapsed time during which the actual system voltage is below the target system voltage, and further comprising adjusting the operation of the alternator only when the first elapsed time exceeds an action time threshold.

15. An electrical power system for a marine vessel having a variable operating device, the power system comprising:

a voltage sensor that measures an actual system voltage for the marine vessel;

a current sensor that measures an actual current drawn by the variable operating device during operation thereof, wherein the variable operating device is operable in an original setting;

a memory system that stores a target system voltage for the marine vessel, a target current for the variable operating device, and a target electrical consumption for the variable operating device;

a control system that determines an actual electrical consumption of the variable operating device based on the measured actual current drawn thereby, compares the actual electrical consumption of the variable operating device to the target electrical consumption, compares the actual system voltage to the target system voltage, and compares the actual current of the variable operating device to the target current; and a control program executable by the control system that, when the actual system voltage is determined to be below the target system voltage the actual current is determined to exceed the target current, and the actual electrical consumption exceeds the target electrical consumption, adjusts the operation of the variable operating device from the original setting.

16. An electrical power system for a marine vessel having a variable operating device, the power system comprising:

a voltage sensor that measures an actual system voltage for the marine vessel;

a current sensor that measures an actual current drawn by the variable operating device during operation thereof, wherein the variable operating device is operable in an original setting;

a memory system that stores a target system voltage for the marine vessel and a target current for the variable operating device;

a control system that compares the actual system voltage to the target system voltage and that compares the actual current of the variable operating device to the target current; and a control program executable by the control system that, when the actual system voltage is determined to be below the target system voltage and the actual current is determined to exceed the target current, adjusts the operation of the variable operating device from the original setting;

wherein the variable operating device is a pump in a power steering system, and wherein the operation of the pump includes a pump speed thereof, wherein the control program reduces the pump speed when the actual system voltage is below the target system voltage and the actual current exceeds the target current.

17. An electrical power system for a marine vessel having a variable operating device, the power system comprising:

a voltage sensor that measures an actual system voltage for the marine vessel;

a current sensor that measures an actual current drawn by the variable operating device during operation thereof, wherein the variable operating device is operable in an original setting;

a memory system that stores a target system voltage for the marine vessel and a target current for the variable operating device;

a control system that compares the actual system voltage to the target system voltage and that compares the actual current of the variable operating device to the target current;

a control program executable by the control system that, when the actual system voltage is determined to be below the target system voltage and the actual current is determined to exceed the target current, adjusts the operation of the variable operating device from the original setting;

a first counter that counts a first elapsed time during which the actual system voltage is below the target system voltage and the actual current drawn by the variable operating device exceeds the target current, wherein the operation of the variable operating device is adjusted only when the first elapsed time exceeds an action time threshold; and a second counter that counts a second elapsed time during which the operation of the variable operating device is adjusted, wherein the operation is prevented from returning to the original setting when the second elapsed time is less than a minimum adjusted time.

18. A method for preserving electrical power in a marine vessel having a marine propulsion device steerable by a steering system having a pump, the method comprising:

operating the pump at a pump speed according to an original setting;

measuring an actual engine speed of the marine propulsion device;

comparing the actual engine speed measured to a target engine speed; and adjusting the pump speed of the pump from the original setting based on the comparison of the actual engine speed to the target engine speed, wherein adjusting the operation changes the electrical power usage by the pump.

19. A method for preserving electrical power in a marine vessel having a marine propulsion device steerable by a steering system having a pump and a steering input device, the method comprising:

operating the pump at a pump speed according to an original setting;

measuring an actual pump speed for the pump;

determining a nominal steering demand from the steering input device based on the actual pump speed measured at the original setting;

measuring an actual steering demand received from the steering input device;

comparing the actual steering demand to the nominal steering demand;

counting a first elapsed time during which the actual steering demand exceeds the nominal steering demand;

comparing the first elapsed time to an action time threshold;

counting an actual event count each time the first elapsed time exceeds the action time threshold;

increasing the pump speed of the pump from the original setting only when the actual event count exceeds a target event count;

counting a second elapsed time during which the pump speed is increased from the original setting; and comparing the second elapsed time to a minimum adjusted time and preventing the pump speed from returning to the original setting when the second elapsed time is less than the minimum adjusted time;

wherein the electrical power in the marine vessel is preserved when the pump is operated with the pump speed at the original settings.

* * * * *